United States Patent [19]

Kasevich et al.

[11] 4,140,179

[45] Feb. 20, 1979

[54] IN SITU RADIO FREQUENCY SELECTIVE HEATING PROCESS

[75] Inventors: Raymond S. Kasevich, Weston; Myer Kolker, Bedford; Arthur S. Dwyer, Braintree, all of Mass.

[73] Assignee: Raytheon Company, Lexington, Mass.

[21] Appl. No.: 756,165

[22] Filed: Jan. 3, 1977

[51] Int. Cl.[2] ..... E21B 43/24; E21B 43/26

[52] U.S. Cl. ..... 166/248; 166/52; 166/60; 166/65 R; 166/271

[58] Field of Search ..... 166/248, 60, 65 R, 245, 166/52, 271

[56] References Cited

U.S. PATENT DOCUMENTS

| | | | |
|---|---|---|---|
| 2,685,930 | 8/1954 | Albaugh | 166/248 UX |
| 2,757,738 | 8/1956 | Ritchey | 166/248 |
| 3,133,592 | 5/1964 | Tomberlin | 166/60 |
| 3,170,519 | 2/1965 | Haagensen | 166/60 |
| 3,614,986 | 10/1971 | Gill | 166/60 X |

FOREIGN PATENT DOCUMENTS 2427031 12/1975 Fed. Rep. of Germany ..... 166/248

OTHER PUBLICATIONS

Fu, "Gasification of Fossil Fuels in a Microwave Discharge in Argon", Chemistry & Industry, Jul. 31, 1971, pp. 876–877.

*Primary Examiner*—Stephen J. Novosad

*Attorney, Agent, or Firm*—M. D. Bartlett; J. D. Pannone; H. W. Arnold

[57] ABSTRACT

The process and apparatus for extracting the products of kerogen in situ from an oil shale body by supplying energy selectively to the kerogen by high frequency electric fields in the frequency range between 100 kilohertz and 1000 megahertz at an intensity which heats the kerogen to a temperature range between 250° C. and 500° C. to allow pyrolysis of the kerogen prior to substantial heat transfer to the surrounding mineral portions of the oil shale.

29 Claims, 15 Drawing Figures

FIG. 2
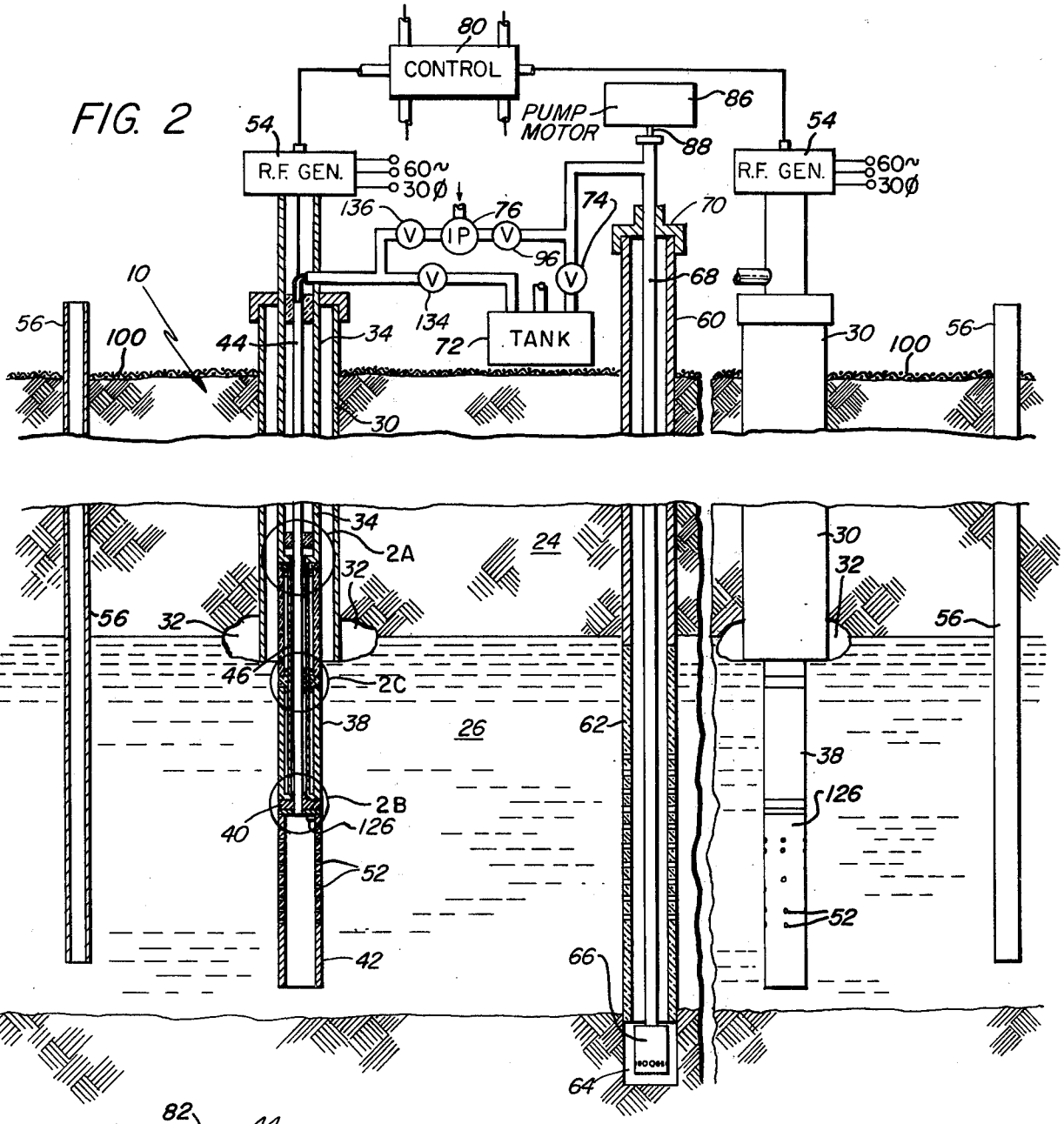
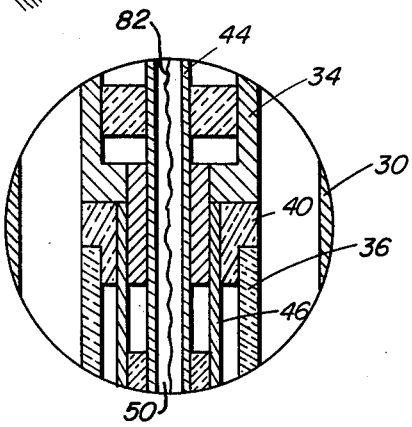
FIG. 2A
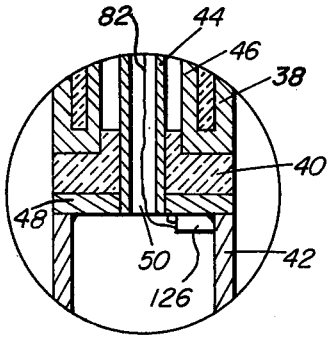
FIG. 2B
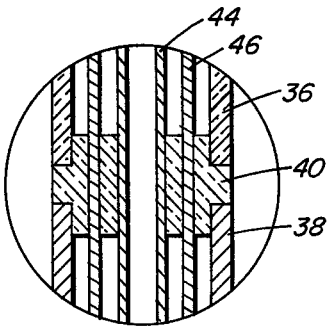
FIG. 2C

POWER IN MW
25
20
15
10
5
1.25
148A
148B
148C
148D
148E
148F
TEMPERATURE IN HUNDREDS OF DEGREES
128
138
154
162
172
186
RADIATOR SURFACE
146
149
156
164
174
188
1 FOOT FROM RADIATOR
152
158
166
176
190
2 FEET FROM RADIATOR
160
168
178
192
4 FEET FROM RADIATOR
170
180
194
8 FEET FROM RADIATOR
182
196
16 FEET FROM RADIATOR
198
32 FEET FROM RADIATOR
0
5
10
15
20
25
30
35
40
TIME IN HOURS

IN SITU RADIO FREQUENCY SELECTIVE HEATING PROCESS

CROSS REFERENCE TO RELATED APPLICATIONS

Application Ser. No. 682,698 filed May 3, 1976 by Howard J. Rowland and Joseph T. deBettencourt, entitled "In Situ Processing of Organic Ore Bodies", and assigned to the same assignee as this application, now abandoned, is hereby incorporated by reference and made a part of this disclosure.

BACKGROUND OF THE INVENTION

In the production of products from subsurface bodies, such as the production of petroleum products from kerogen in oil shale, it has been the practice to mine the shale by mechanical means and to retort the shale to temperatures producing chemical changes, hereinafter called pyrolysis of the kerogen. At such temperatures, the kerogen products are largely vaporized or are sufficiently liquid to run out of the pores and fractures in the shale rock to be collected for further processing. Such products at room temperature have substantial portions of high viscosity such that they will not flow, for example, through pipe lines, and they must be treated, for example, by hydrogenation to produce useable, commercially marketable products. The total cost of such processes renders them generally uneconomic.

In addition, such processes produce large amounts of spent shale having components from which undesirable pollutants will be leached by rainfall.

Attempts to process bodies of oil shale in situ by heating the kerogen in the oil shale, for example, injecting super-heated steam, hot liquids or other materials into the oil shale formation, have not been economically feasible since, once kerogen is converted to products which flow, large portions of the kerogen were also converted to products which do not flow and which, in fact, could plug the formation since temperatures in some locations exceeded desirable limits, such as 500° C. Attempts to maintain temperature uniformity below 500° C., while still above temperatures such as 250° C. at which the kerogen would pyrolyze at reasonable rates, have been unfeasible since, for example, with steam injected into the formation, thermal conductivity through the shale or kerogen must be relied on to transmit the heat to all portions of the kerogen, and such thermal conduction uniformly heats both the inorganic or mineral portions of the oil shale as well as the organic portion of kerogen in the oil shale.

In addition, since such heat transfer by conduction takes years to bring oil shale up to temperatures where kerogens are pyrolized, regions closest to the heat source, having already gasified and liquified, are free to flow through fissures or fractures in the formation, and in a period of years can largely escape from the formation.

For the purposes of this invention, the term, "conductivity", is that given in Dielectric Materials and Applications by A. Von Hippel published by John Wiley & Sons, Pg. 4, equation (1.16).

SUMMARY OF THE INVENTION

In accordance with this invention, a subsurface body containing organic compounds may be heated in a controlled manner to temperatures at which chemical reactions occur at substantial rates while maintaining substantially all portions of the body below maximum temperatures above which undesirable reactions occur.

More specifically, this invention provides for heating kerogen in oil shale with electric fields having frequency components in the range between 100 kilohertz and 100 megahertz where dry oil shale is selectively heated, with kerogen-rich regions absorbing energy from said fields at substantially higher rates than kerogen-lean regions.

In addition, this invention discloses that, by fracturing the formation of oil shale in a desired region to be treated and then preheating the region to a temperature above the boiling point of water by any desired means, the free water in the shale oil body may be converted to steam and permitted to escape into the surrounding regions through fissures where, preferably, it condenses to partially preheat such regions. Alternatively, the steam may be vented to the surface via wells or other structures in the formation where it may be condensed to produce water.

This invention further discloses that the penetration of the radiated electromagnetic waves into a region of a shale oil body is greater when the region is substantially free of unbonded water. For example, at one megahertz, effective radiation penetration up to 100 meters may be achieved depending upon the particular composition of the oil shale body and the quantity of kerogen in the formation. In addition, after the kerogen has been converted to flowable products which have flowed out of the formation into collecting regions, penetration through the shale, which is now leaner, becomes still greater.

This invention further discloses that such radiation penetration is confined in a vertical direction from a normal free space radiation pattern for vertically polarized waves radiated, for example, from a dipole by reason of the layered condition of the formation which acts as a lens of layers of different dielectric constants so that the portion of such radiated energy appearing at the surface of the overburden is substantially reduced. In addition, by allowing the overburden to remain saturated with water, such energy passing into the overburden is largely absorbed and, hence, radiates to a substantially lower degree into the atmosphere to produce undesirable interference.

This invention further provides that any such interfering atmospheric radiation may be suppressed by positioning a conductive screen on or adjacent to the surface of the formation. Such a screen, if desired, may in fact be a layer of conductive plastic or a metal screen covered with plastic which will capture any gases penetrating through the overburden in the area surrounding the collection wells or the radiation application structures.

This invention further provides that the radiation application structures may comprise dipole structures vertically oriented to provide maximum gradients at the centers of the dipoles and that such structures may be made more directional by putting reflecting structures at spaced locations from the dipoles.

This invention further provides that the radiated power applied to the dipole radiators may be pulsed so that the dry oil shale which can produce localized hot spots of crystalline size, for example, a few millimeters in diameter, will dissipate by thermal conductivity to the surrounding structure so that overheating of local points in the formation is avoided. For example, such pulsed heating may have a cycle of twenty seconds on/forty seconds off or any other desired cycle sequence.

This invention further provides that for dry formations the electric field may be selected of a frequency where the absorption rate of the kerogens and partially converted products is several times that of layers of shale containing little or no kerogen or regions of rock from which the kerogen has been removed. The electric field power is preferably applied at an intensity sufficient to raise the kerogen to a temperature in the range between 250° C. and 500° C. while adjacent mineral portions of the oil shale, referred to herein as shale, remain at temperatures substantially below the temperature of the kerogen, for example, in the range between 150° C. and 300° C. Such a difference in heating being referred to herein as selective heating.

Conversion of the kerogen by pyrolysis preferably occurs during or after selectively heating the formation in a period from minutes to days dependent on the temperature and preferably prior to substantial conductive transfer of heat from the kerogen-rich layers to the adjacent layers of kerogen-lean layers which may also be shale with substantially no kerogen so that the overall formation has an average temperature substantially below 250° C., below which the mechanical strength of the lean shale will retain fissures produced therein through which the pyrolysis products may flow.

This invention further provides that the radiated energy may be applied while pressures of several hundred to several thousand psi are produced in the oil shale formation so that the electric field may have high intensities such as many thousands of volts per meter without arcing at the electrode surfaces or in the formation.

This invention further discloses that the electric field producing structures may be cooled by circulation of fluids therethrough and/or by injecting inert fluids therethrough into the regions immediately surrounding the electrodes to reduce the absorption of energy in these regions from said fields and/or to transfer thermal energy outward from electrodes into cooler regions of the formation.

This invention further discloses that a plurality of groups of radiating electrodes may be positioned in spaced locations in the formation, having directional radiation patterns directed toward a common region containing a structure which may sense temperature and/or in which the products of kerogen may be collected.

This invention further discloses that the spacing of such groups may be, for example, on the order of a half wavelength of the frequency applied to the formation and that the radiated waves may be applied in phase to the radiating structures so that energy from one radiating structure will arrive at the other radiating structure out of phase and will cancel a portion of the radiating field gradient thereby reducing the heating effect in the regions immediately adjacent the applicators while such field will at least partially add in other regions of the formation to even the heating of the formation.

BRIEF DESCRIPTION OF THE DRAWINGS

Other and further objects and advantages of the invention will be apparent as the description thereof progresses, reference being had to the accompanying drawings wherein:

FIG. 2 illustrates a vertical section of a shale oil formation of FIG. 1 taken along line 2—2 of FIG. 1;

FIGS. 2A, 2B and 2C illustrate details of the system shown in FIG. 2;

DESCRIPTION OF THE PREFERRED EMBODIMENT

Figure 1:
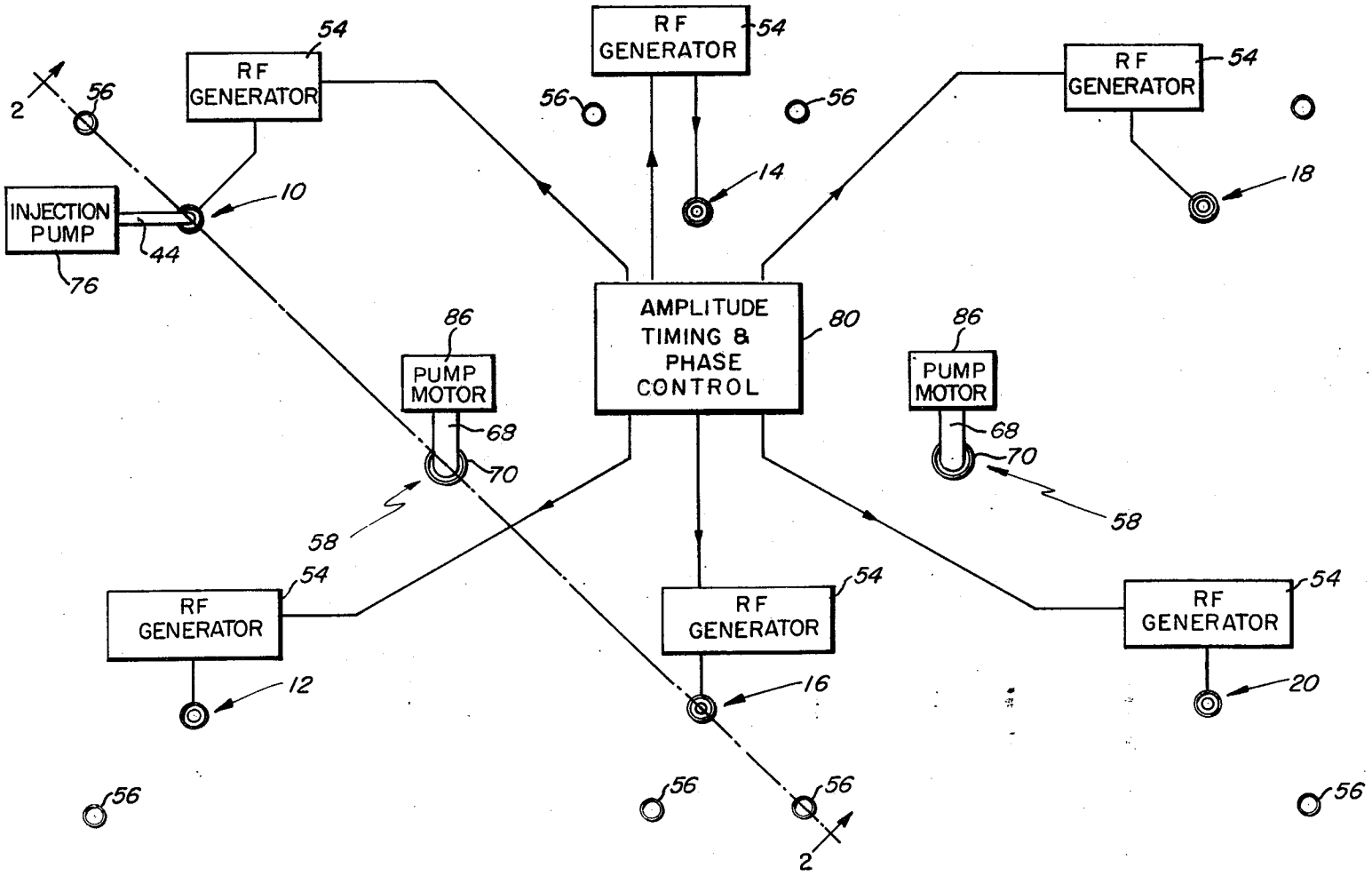
FIG. 1 illustrates a plan view of an in situ oil shale kerogen recovery system embodying the invention.

Referring now to FIGS. 1 and 2, there is shown a plurality of electrode structures 10, 12, 14, 16, 18 and 20 positioned in six locations, and extending from the surface through overburden 24, which may be several hundred feet thick, into an oil shale body 26 of from ten to 1000 feet thick. A substrata, which may be rock, consolidated sands, silt or other material, supports body 26.

Structures 10 through 20 are preferably similar and, as shown in FIG. 2, may consist of an outer casing 30 extending substantially through the overburden and preferably sealed to the formation by injecting a sealing region 32, for example, of cement during the installation process. Positioned inside outer casing 30 is an electrode structure comprising a metal sleeve 34, for example, eight inches in diameter, extending to a point above the lower end of outer casing 30. A ceramic cylinder 36 extends from the lower end of sleeve 34 to a point below the lower end of casing 30. A half wave dipole has its upper section as a metal cylinder 38 extending from the lower end of ceramic cylinder 36. Ceramic blocks 40 are positioned between the ends of cylinders 34, 36 and 38 and between metal cylinder 42 which extends from the lower end of cylinder 38.

Cylinders 42 and 38 form a radiating dipole in formation 26, below overburden 24, which is fed by a coaxial line comprising a central tubing 44 which extends from the surface through sleeve 34, insulated therefrom by insulating spaces, through a metal sleeve 46 connected between the lower ends of cylinders 34 and 36 and through blocks 40 to an apertured metal plate 48 welded between the upper end of cylinder 42 and the lower end of tubing 44. Tubing 44 has a central bore 50 through which gaseous pressure or other fluids may be injected into or extracted from lower cylinder 42 and, hence, into or out of the formation through apertures 52 in cylinder 42.

As shown herein, R.F. generators 54, connected between central conductors 44 and cylinders 34, supply energy to the dipole structures comprising the radiators 38 and 42. Preferably, the dipole is substantially one-half wavelength or less in length in the shale oil formation in a temperature range on the order of 250° C. to 500° C. For example, if the energy has a frequency of one megahertz, the dipole length is approximately 50 meters. Alternatively, a quarter wave radiator comprising the lower half of dipole may be used, if desired. If additional directionality of the radiation pattern is desired, parasitic radiation elements 56 may be inserted into the formation, spaced from the dipole radiation structures 10 through 20 by distances on the order of one-eighth wavelength and positioned to direct the radiation patterns from radiators 10, 12, 14, and 16, for example, to the center of the square which they define.

As illustrated herein by way of example, a temperature sensing or producing structure 58 may be located at the center of the square and comprises a steel casing 60 extending through the overburden 24 and attached to a perforated ceramic section 62 extending through the oil shale into a sump 64 containing a pump 66 attached to tubing 68 through which the products of pyrolysis of kerogen in the shale oil may be brought to the surface. Pump 66 may be electrically actuated in sump 64 or, as shown, may be actuated from a pump motor 86 at the surface and connected to pump 66 through a rotating or reciprocating rod 88 extending through tubing 68. Tubing 68 is sealed to casing 60 by a sealing cap 70 so that gaseous products of the pyrolysis as well as liquids may flow to a storage tank 72 connected to production tubing 68 through a valve 74.

It should be clearly understood that any desired form of pump can be used and that production casing 62 and tubing 68 may be of ceramic, such as alundum, if desired. In addition, it is contemplated that production casing 60 may, if desired, be drilled through oil shale body 26 into the sump and then withdrawn to a position in the overburden 24, with the aperture thus formed in the shale remaining without additional structure and production tubing 68 may be withdrawn through cap 70 into the overburden while radiation is applied to the formation by the dipole structure 10 so that it will have substantially no effect on the radiation pattern produced in the formation.

The example of the radiating electrode structure described herein and by way of example only and many different electrode configurations can be used. In addition, the electrode structure may be impedance matched to the formation and to the transmission line by other means in combination with the quarter wave sleeve 46 within the upper electrode. For example, dielectric coatings of ceramic, such as alundum, may be applied to the outer surface of the dipole radiators which also reduces the maximum field gradient at the electrode surface, and the length of the dielectric block between the two halves of the dipole may be increased to any desired length to match the impedance presented by the transmission line while also reducing the maximum field gradient in the immediate region of the center of the dipole.

As shown herein, a master timing amplitude and phase control unit 80 supplies drive signals with appropriate phases to R.F. generators 54, each of which is connected to one of the electrodes 12 through 20. Individual R.F. drives to the radiators 10 through 20 may be supplied from controller 80 to individually actuate each of the generators 54 to generate power of a few KW to 25 MW in the form of R.F. energy in the frequency range from 100 kilohertz to 1000 megahertz.

Generators 54 are supplied with electric power from a conventional three-phase high voltage line 78.

If, for example, 1 megawatt of power is supplied to a radiator having a total surface area of 30 square meters, voltage gradients on the order of several hundred volts per inch can be produced in the formation adjacent the radiator. It is therefore preferable to provide substantial pressure in the formation adjacent the radiator to prevent corona discharge voltage breakdown at the radiator surface.

Such pressure may be generated by heating gases or steam in the formation or may be injected as gas or liquid by injection pumps 76 through tubings 44.

While at low temperatures below 100° C., the power levels below 1 megawatt at a frequency of one megahertz, little or no corona discharge may be encountered. However, when power levels up to 25 megawatts are applied to such a radiator at temperatures on the order of 500° C., corona discharge may be encountered. Since such corona produces localized uncontrolled heating, it is preferably suppressed, for example, by injecting a low conductivity, high dielectric strength fluid into the formation through the radiator. Such a fluid can be transformer oil which reduces the electric field gradient in the region of the electrode structure, or high pressure inert gas such as carbon dioxide at a pressure of several atmospheres or more. In addition, the radiating electrode diameter can be made greater than eight inches with electrode diameters of several feet being used in formations having constituents which will produce corona discharge at relatively low electric field strengths at elevated temperatures. Determination of the extent and nature of these expedients to reduce corona discharge may be predicted in advance by measuring the properties of a core sample of each formation to be processed.

DESCRIPTION OF THE PREFERRED PROCESS

In accordance with this invention, there is hereinafter described an example of a process for extracting the products of kerogen in situ pyrolysis of an oil shale body using, for example, a radiating electrode structure of the type shown in FIGS. 1 and 2.

Heating of the oil shale formation in the region of dipole radiator 10 to a temperature sufficient to vaporize the free or unbonded water in the formation is preferably accomplished by the application of electric fields at a frequency on the order of one megahertz to bring the portion of the formation to be selectively heated to a temperature above 100° C. while also partially fracturing the formation. Such electric fields are applied as captive fields in accordance with the teaching of the aforementioned copending application or as radiating fields of the type set forth herein. It is contemplated that other forms of preheating and/or fracturing the formation may also be used such as the injection of superheated steam or gases. In addition, steam or other gases previously produced in processing another portion of the formation may be driven either through the formation or reinjected into the formation through appropriate electrode or well apertures.

Figure 3:
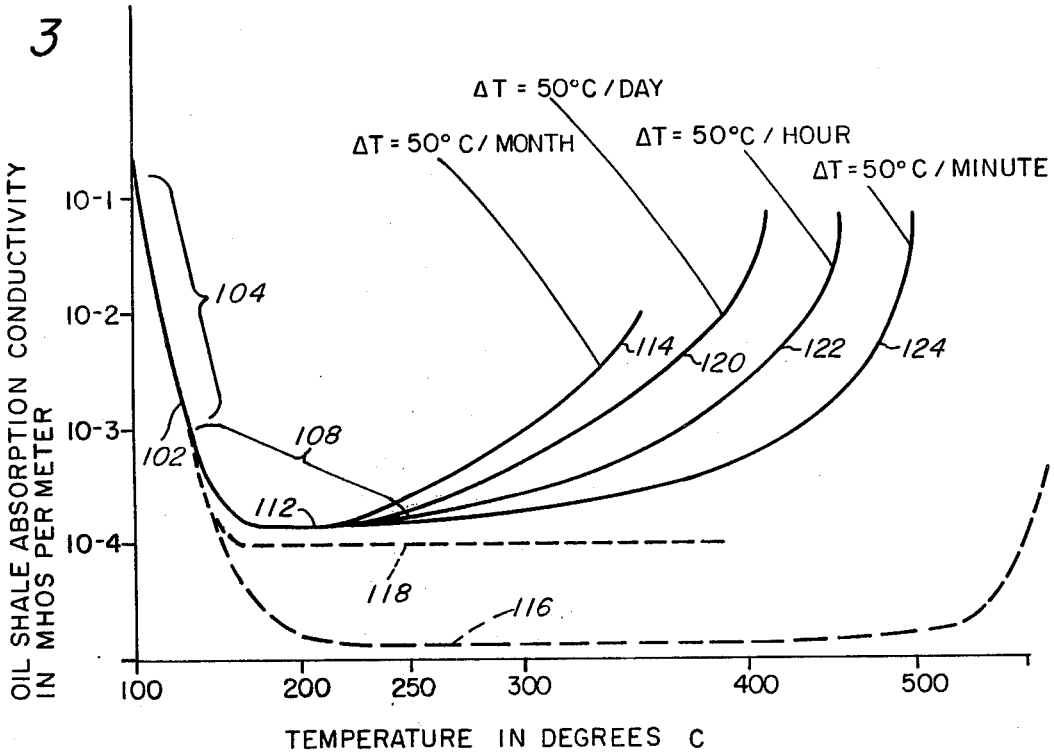
FIG. 3 illustrates graphs of patterns in the shale oil structure.

Energy of, for example, one megahertz at a power level up to one megawatt when used to heat the formation to vaporize the water may be applied to each of the radiators 10 through 16 to produce a high energy absorption in the region 102 of curve portion 104 in FIG. 3. During this period of time which may be on the order of hours to days depending among other things on the water content in the oil shale body 26, the temperature of the body is raised to temperatures at which the free water in the oil shale is converted to water vapor, partially fracturing the oil shale body and providing fissures through which the water vapor, together with other gases which may be produced at these temperatures, flows into the producing well 64 and is collected in tank 72. During this portion of the heating cycle, if desired, cool liquid or gas under pressure may also be injected through apertures 52 into the formation to reduce the temperature in the immediate vicinity of the radiating structures 10 and to maintain pressure around the radiators while assisting in the fracturing process.

FIG. 3 shows the amount of energy absorbed as the formation is dried and is plotted as the electrical conductivity in mhos per meter which is reduced from a value which may be in excess of $10^{-1}$ to a value on the order of $10^{-3}$ or lower as shown by curve 102 when the major portion of the free moisture in the particular oil shale region has passed out of that region. It may be noted that such water vapor may, if desired, be forced into lower temperature surrounding regions of the formation such as the overburden, substrata, or more distant oil shale regions and condense to add heat to these regions. Such an action is in some formations desirable to preheat the surrounding regions of the formation in preparation for subsequent applications of heating energy by electric field and/or for increasing the radiation loss in the overburden to reduce the amount of radiation at the surface of the body. Such surface radiation from the body may also be suppressed by a shield of conductive screen 100 or conductive plastic preferably covering the entire surface of the body to be processed.

The temperature of the formation in the immediate region of the radiators may be sensed, for example, by a thermocouple 106 connected to the surface by a conductor 82 in central bore 50 which will shut down R.F. generator 54 when the temperature exceeds any desired predetermined level.

Other ways of sensing the temperature, extent of conversion of the kerogen or depth of penetration of the radiated energy may be used. For example, small ceramic pipes which will withstand temperatures in excess of 500° C. and which are transparent to radiant energy, such as alundum, may be positioned in any desired location and at any desired distance from the radiating electrode structure and radiation sensing dipoles may be inserted therein to determine field strength and/or thermocouples inserted therein to determine temperature. Power then radiated from the radiating electrode structure may be then sensed at sensing dipoles to determine penetration into the formation. Radiation impedance can be determined, for example, by measuring the standing wave ratio from the input transmission line to the radiating electrode and/or the energy transmitted through the formation to the sensing location, the condition of the intervening formation may be estimated. Since such characteristics vary widely with different type of oil shale, a precalibration of such measurements is preferably first undertaken by measuring a sample of the oil shale obtained from a core of the electrode bore hole. For such purposes, measurements may be taken at any of a variety of frequencies and measurements at different frequencies compared to further refine the estimate of the temperature and percentage conversion of the kerogen as well as other characteristics of the formation.

In dry oil shale, the conductivity continues to be reduced, as shown by the curve portions 108, reaching a minimum approaching, for example, $10^{-4}$ mhos per meter at a temperature around 250° C. as shown by curve 112. In this region the major portion of the power is absorbed by the kerogen as shown by curve 118, which assumes sufficiently rapid rise in temperature that no pyrolysis has yet taken place and the conductivity of the inorganic or mineral portion of the oil shale approaches $10^{-5}$ mhos per meter as shown by curve 116.

As shown by the portions of the formation conductivity curves 114, 120, 122, and 124, different radiation rates produce different energy absorption increases with temperature above 250° C. due partly to conversion of the kerogen to higher conductivity products.

In temperature region 102, the components of R.F. energy absorption attributable to the mineral or inorganic portions of the oil shale have been found to be relatively indistinguishable due to the moisture content normally found in such oil shale which may vary from a fraction of a percent to three or more percent by weight. The downward slope of curve portion 102, as temperature is increased, is due not primarily to changes in temperature but rather to the vaporizing of free water which as a liquid dissolves salts from the formation to produce a mixture which readily absorbs R.F. energy over a wide band of frequencies.

However, in accordance with this invention, a distinct difference between the loss characteristics of the kerogen or organic layers of the oil shale and the inorganic layers or mineral layers of the oil shale occurs when the free water is vaporized. For example, the mineral portion of the oil shale will exhibit a conductivity, as shown by dotted line 116, which is well below $10^{-4}$ mhos per meter. The shape of the curve 116 in the region varies substantially with pressure and time which determines the water vaporization point region of the formation and/or the time necessary for the wet portions of the vapor to migrate out of the formation either to the producing well or to surrounding areas of the formation.

At temperatures in excess of 500° C., water and other materials bound into the formation may be released and the strength of the formation becomes sufficiently reduced to merge into the existing organic layers so that the conductivity curve 116 rapidly rises. The organic portions of an oil shale, which yields 40 gallons of kerogen products per ton amounts to approximately ten percent by weight, will thus absorb most of the 1 Mhz radiated energy at temperatures between 200° C. and 500° C. as shown by the dashed curve 118, with the sum of curves 116 and 118 at any particular temperature below 250° C. approximating the value of curve 112.

Above a temperature of approximately 250° C., the kerogen in the oil shale begins to pyrolyze to produce gases and liquids at a rate which takes from hours to months to complete, dependent on the temperature and the pyrolyzed products exhibit a substantially higher loss than the unpyrolyzed products. Thus, if the kerogen were heated from 150° C. to 500° C. at the rate of 50° C./month, the absorption rate would approximate that of curve 114, while more rapid heating rates would produce curves 120, 122 and 124 for heating rates of 50° C./day, 50° C./hour and 50°/minute, respectively. These curves, which are for a small region of an oil shale formation and are by way of illustration only, and different oil shale bodies will exhibit different characteristics producing different curves.

In accordance with this invention, the differential loss characteristic between kerogen and mineral shale is used to selectively heat the kerogen to a substantially higher temperature than the inorganic layers of oil shale thereby rapidly bringing the kerogen up into its pyrolysis range between 250° C. and 500° C., while heating the adjacent inorganic portions of the oil shale formation to a temperature substantially that of the kerogen and preferably below the softening temperature of the shale formation, between 300° C. and 400° C., so that formation fractures remain open. During such heating, pressure is preferably maintained on the formation with vanes 74, 96, 134 and 136 closed so that pyrolysis of the kerogen preferably occurs to a substantial extent prior to conductive or convective flow of the major portion of thermal energy from the kerogen into the surrounding inorganic shale regions. Thus, since only the kerogen, which may constitute ten percent by weight of the oil shale body, is heated to temperatures above 300° C. for pyrolysis, a substantial saving in heating energy is achieved. Radiation is then stopped and the kerogen pyrolysis products flow through fissures in both the organic and inorganic layers of the shale to the producing well 60 or, alternatively, into cylinder 42 and up through tubing 44 at a rate dependent on the pressure which is adjusted by partially opening one or more of valves 74 and 134, reducing the formation temperatures due to gas expansion and transfer of heat to the inorganic regions of the oil shale.

Figure 4:
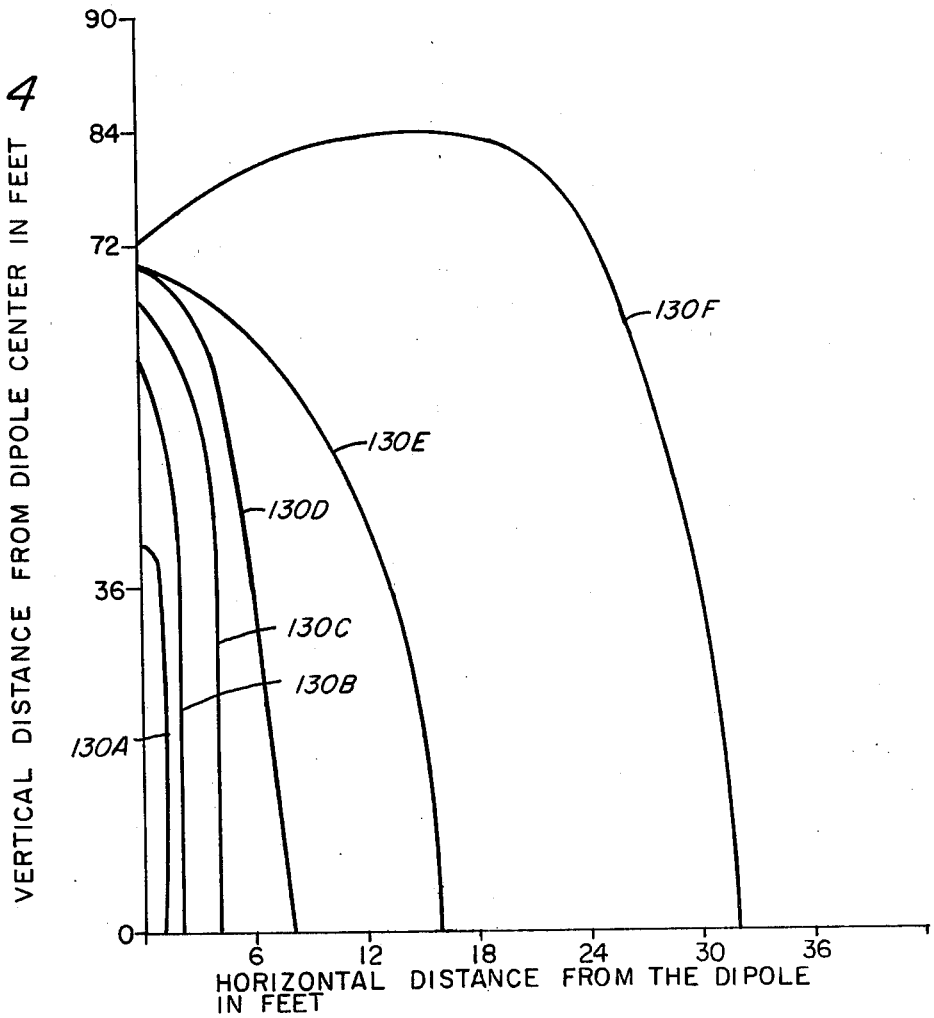
FIGS. 4 and 5 illustrate the temperatures at various points in the kerogen for different elapsed times for an embodiment of the invention.

Referring now to FIGS. 4 and 5, there will be described an example of a pyrolysis heating sequence embodying the preferred process for producing the pyrolyzed products of kerogen in situ from oil shale. For the purposes of explanation of the principles of this invention, no radiation directivity in the horizontal plane is provided, in the interest of simplification and clarity of the explanation.

Figures 5A, 5B, 5C, 5D, 5E, 5F, 5G, 5H:
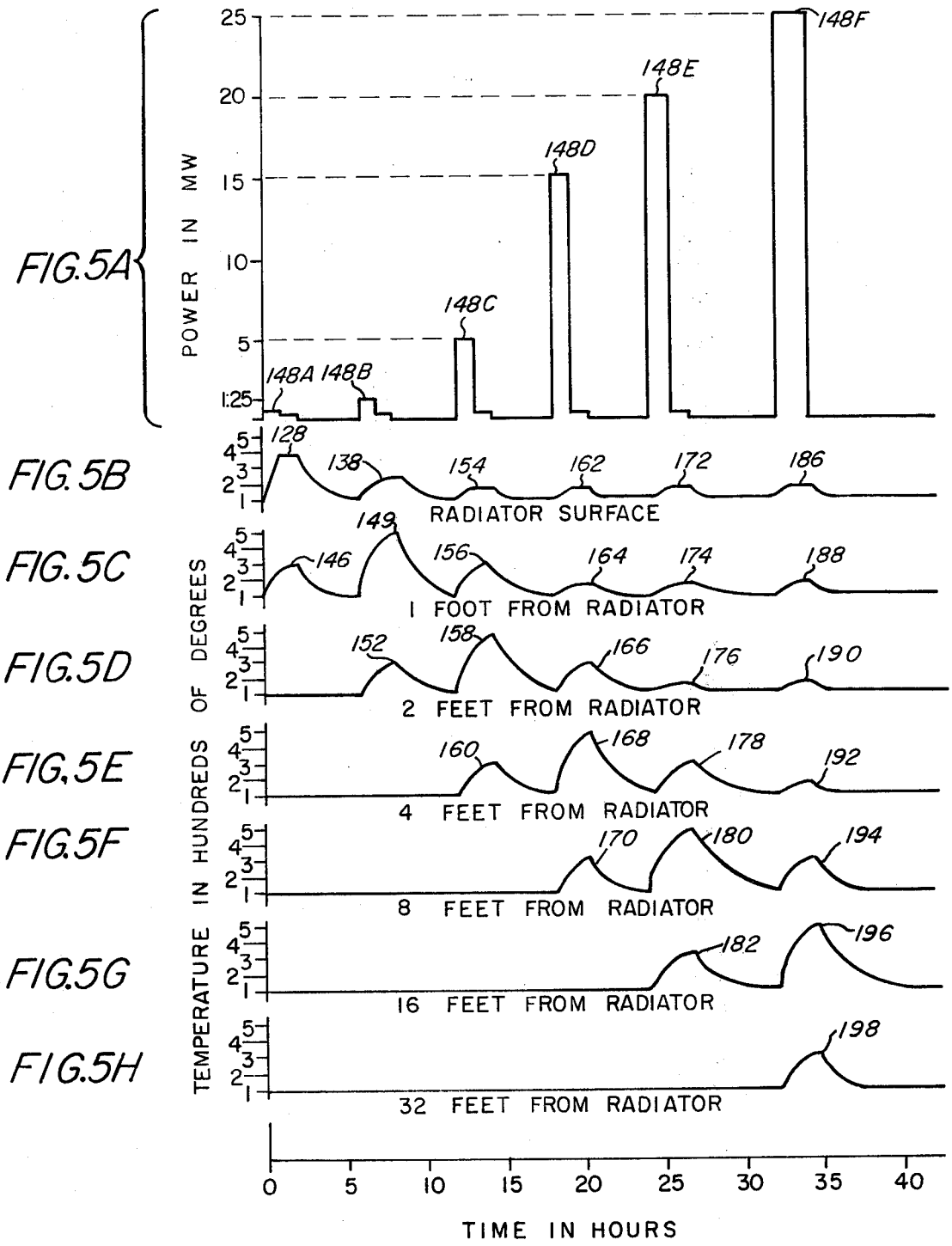

Curves 130A through 130F of FIG. 4 are for distance contours from the radiator reaching 300° C. after the R.F. power levels 148A through 148F shown in FIG. 5A have been supplied to the radiator. Curves 5B through 5H show the temperatures for distances of one foot, two feet, four feet, eight feet, sixteen feet and thirty-two feet from the radiator, with the power sequence shown in FIG. 5A supplied to the radiator. While the peak radiated power illustrated herein is 25 megawatts supplied to a single dipole radiator approximately 150 feet long and, for example, from a few inches up to several feet in diameter, higher powers may be used, being limited by the peak voltage gradient in the formation adjacent the radiator which will produce a breakdown by corona discharge and arcing. Generally, higher voltage gradients may be produced in the presence of higher pressures and, for this purpose, during the application of R.F. energy at peak powers, a pressure sufficient to substantially reduce vaporization of fluids produced by heating the kerogen and/or minerals, such as, for example, 1000 psi, is preferably maintained in the formation adjacent the electrode structure.

In operation, a power 148A of, for example, 500 kilowatts is applied to the electrode for a period of time such as 1 hour sufficient to raise the formation temperature adjacent the electrode as sensed by thermal sensor 126 in the block 40 at the dipole center to approximately 500° C. as shown by point 128 of curve 5B, and to 300° C. at a distance one foot from the surface of the radiating electrode as shown by point 146 of curve 5C. The power level is then reduced and the formation is allowed to rest for an hour, with approximately 25 kilowatts of energy applied to the radiator, during which time the temperature at the surface of the radiator is maintained at approximately 500° C., with more or less power being supplied as required to maintain the temperature. For example, in the event that the radiator exceeds 500° C., the thermocouple 128 shuts off the R.F. generator for a minute until the temperature has been reduced by conduction, for example, by 20° and then restarts the generators. At the end of an hour, a major portion of the kerogen in the formation in the region between the radiator surface and curve 130A is converted by pyrolysis predominantly to fluid products including products which will readily vaporize at pressures below 1000 psi.

The R.F. generator is now turned off and the formation pressure reduced by opening valve 134, leaving injection pump valve 136 closed, to allow the gaseous products of the pyrolysis to out-gas from the formation, driving substantially the fluid products of pyrolysis through apertures 52 into the radiating electrode structure and up through tubing 44 and valve 134 to storage tank 72. In addition, valve 74 may be opened and liquid in sump 64 pumped to the tank by pump 86 through tubing 68. During this period the formation between curve 130 and the radiator is cooled by the expansion of the pyrolysis product gas as well as by vaporization of any water produced from decomposition of the mineral shale in the formation or remaining in portions of the formation beyond curve 130 so that the electrode surface of curve 5B is reduced to a temperature of, for example, less than 200° C. as sensed by sensor 126 during the following four-hour period. The temperature of the one-foot contour curve 7B is also reduced, for example, to 150° C. Generally, temperatures below this level will not be achieved since water vapor condensing in the formation will give up heat to the formation. The foregoing heating is dependent on the observed phenomenon that kerogen absorbs heating from R.F. energy at a rate on the order of magnitude or more greater than that of mineral shale once free water in the formation has been converted to water vapor or steam. That is, the conductivity of mineral shale as shown by curve 116 in FIG. 3 is at least an order of magnitude less than kerogen as shown by curve 118 at temperatures above 200° C.

Thus, the amount of R.F. energy required to produce the major portion of the pyrolysis products of kerogen in the region between curve 130A and the radiator may be several times less than that required if the entire oil shale body in this region were heated, for example, to 300° C. It may be noted that for this to occur, the region must have first been freed of liquid water. This may be achieved, for example, in the event that no heat has been previously applied to the formation by applying the R.F. energy at a high rate, such as a megawatt, until the temperature registered by sensor 126 reaches, for example, 150° C. while leaving valve 134 open so that water vapor products may be driven through the apertures 52 and out through the valve 74.

Alternatively, the valve 74 may be left open to allow water vapor to be driven further into the formation and upon condensing to be driven into the collecting sump 64 and, hence, out of the region of exposure to the R.F. fields. Preferably, however, the formation in the region has already been heated to a temperature in excess of 100° C. by any desired means such as injection of fluids or by prefracturing and heating by captive fields between electrodes, as more completely disclosed in the aforementioned application Ser. No. 682,698.

In some formations it may be desirable to inject low conductivity fluids into the formation, an injection pump 140 which pumps the fluid valve 136 and tubing 44. Or valve 96 and tubing 68 to flush the formation free of the kerogen pyrolysis products and/or water vapor produced in the formation. The temperature of the region between curve 130 and the radiator is now that of the layers of mineral shale due to thermal conduction, and approximates the temperature of the formation two feet from the radiator which is about 100° to 150° C.

The valves are now closed and R.F. power is again applied to the radiator, initially for a few minutes at, for example, one-half a megawatt, to build up formation pressure, then at about 1.25 megawatts for approximately one hour as shown at point 148B of curve 5A, bringing the temperature of curve 5C up to 500° C. 1 foot from the radiator as shown by point 149 of and the radiator surface temperature, as shown by point 154 of curve 5B, to a temperature of, for example, 200° C. The lower temperature of point 154 occurs since the kerogen has been already converted in the region immediately around the radiator and driven out of the formation region adjacent the radiator so that the formation conductivity immediately adjacent the radiator is reduced from that of curve 112 by an order of magnitude or more, to that of curve 116 so that the heating in this region is substantially reduced. Thermostat 126 at the radiating electrode surface provides data from which the 500° C. temperature at the one-foot distance of contour 130A can be estimated.

Power is now reduced to a level of 25 kilowatts, for example, to maintain the temperature of point 149 at 400° C. to 500° C. for a period of one hour or until the major portion of the kerogen between the radiator and the two-foot contour shown by curve 130B is converted to kerogen. In addition, the temperature at the two-foot contour is raised to 300° C. as shown by point 152 of curve 5D.

The pressure is now reduced by opening the valves to allow the products of the pyrolysis of kerogen in the regions of the one contour and two-foot contours to be driven into the well sump and/or up through the tubing 44. After a period of four hours, the temperatures of curves 5B, 5C and 5D, respectively, return to temperatures below 200° C.

The valves are then closed and power is applied to the electrode in steps of one-half a megawatt for a few minutes to build up formation gas pressure and then five megawatts for an hour which raises the surface of the electrode to 200° C., as shown by point 154 of curve 5B, with the one-foot and two-foot regions being raised to approximately 300° and 500° C., as shown by points 156 and 158 of curves 5C and 5D, respectively. In addition, the four-foot contour 130C of FIG. 4 is raised to a temperature of approximately 300° C. as also shown by point 160 of curve 5E.

The formation pressure during such heating may reach 1000 psi or greater due to out-gassing from the kerogen and/or the mineral, and preferably, such gas is retained substantially in place during pyrolysis of the kerogen to minimize transfer of thermal energy from the kerogen to the shale mineral or the gas.

As previously noted, in these processes the kerogen amounts to ten percent by weight, or less, of the entire shale or body and, hence, the amount of R.F. energy required is substantially reduced from that which would be required to heat the entire body of oil shale, for example, to a temperature of 200° C. Also, the region adjacent the radiator is spent shale, that is, shale that has been completely retorted, and presents, therefore, very low conductivity to the radiated wave. During this pyrolysis cycle, approximately 100 kilowatts of power are radiated into the formation for an hour and the power is then turned off. The major portion of the kerogen out to the four-foot contours of curve 130° C. has now been converted to the produces by pyrolysis. A reduction in formation pressure is achieved by opening the valves and producing the pyrolysis products through tubing 44 on into sump 64. The temperature of the radiative electrode drops to below 150° C. during a period of four hours, with the temperature of curves 5B through 5E during this period returning to temperatures below 200° C.

The valves are closed and the R.F. power is now applied at a fifteen-megawatt rate for about an hour, as shown by 148D until the thermocouple 126 again senses a temperature of 200° as shown by point 162, and the power is reduced for one hour to 100 kilowatts to maintain the temperatures, producing substantial pyrolysis of kerogen in the region between the four-foot contour 130C and curve 5E and the eight-foot region curve 5F and raising the temperature of curves 5C and 5D to approximately 200° C., and curve 5E to 500° C., curve 5F and raised to 300° C. as shown by points 164, 166, and 168, respectively. Power is then turned off for four hours, during which time valve 74 is opened and the formation gas pressure and, if desired, $CO_2$ injected by injection pump (IP) through valve 136 drives the pyrolyzed products of kerogen into the well, while the formation temperatures drop to below 200° C.

The valves are closed and power is again turned on at a level of 20 megawatts as shown by 148E, until thermostat 126 senses a temperature of 225° C., as shown by point 172, which, for example, takes approximately 1.5 hours, and curves 5C and 5D achieve temperatures of 225° C. as shown by points 174 and 176 . The four-foot contour of curve 5E achieves a temperature of approximately 300° C., at point 178 curve 5F achieves a temperature of 500° C. at point 180 and curve 5G achieve a temperature of 300° C. as shown by point 182 and contour 130E. The power then reduced to 100 kilowatts for one hour and turned off while the valves are opened to produce the pyrolysis products. It may be noted that, during the production of the products of kerogen by reduction of pressure, the cooling produced by expansion of the gases will cause some condensation of residual traces of moisture in the formation. However, the effect of such condensation is to return heat to the formation, and upon adding of the heated energy to the formation to produce additional gasification of the kerogen, such vapor and liquid water, which are in fact the furthest from the radiating electrode, are driven deeper into the formation so that the formation in the area of primary interest for selective heating, that is, those kerogen rich regions closest to the radiator are maintained substantially free of water vapor and, hence, the selective heating phenomenon remains substantial.

After four hours the foregoing pressure and heating cycle of operation is repeated with 25 megawatts of power for about 2 hours as shown by 148F to produce temperatures of about 250° C., 125° C., 125° C., 300° C., 500° C. and 300° C. on curves 5B through 5G, shown by points 186, 188, 190, 192, 194 and 196 and respectively, 300° C. shown by contour 130F and point 198 of curve 5H. The valves are then opened and the pyrolysis products are produced.

In all of the foregoing cycles, the intensity and time duration of application of the R.F. energy to the oil shale is preferably selected to raise the temperature in a sufficiently short time that a substantial portion of the R.F. energy is used to heat and maintain the kerogen in the conversion temperature region for a period of time long enough to allow a substantial portion of kerogen conversion prior to the thermal energy in the kerogen being transferred to surrounding mineral oil shale regions. As a result, the surrounding regions remain at a temperature below that at which they would lose structural strength and, hence, collapse the fissues formed therein through which the pyrolysis products flow.

As may be seen, from the contours of FIG. 4, as the power level and penetration of radiation is increased, the face contour at which 300° C. is first reached will move both up and down from the midpoint of the dipole radiator and eventually for large deep power penetrations, extend somewhat above and below the ends of the dipole radiator, the exact contours being dependent on the constituents of the formation.

Alternatively, the R.F. energy may be applied either simultaneously or sequentially to the radiating elements 10 through 16 and which preferably has the same frequency being applied to each element. The phase is preferably controlled such that energy radiated, for example, from structure 10 to structure 12 will arrive at structure 12 out of phase with energy radiated from structure 12. This may be accomplished, for example, by having the radiation from structures 10 through 16 being all in the same phase and the structures 10 through 16 spaced one half wave length at the radiation frequency in the formation.

The foregoing description is by way of illustration only and assumes spacing of several inches between layers of rich shale in excess of 40 gallons per ton by regions of shale containing little or no kerogen. In practice, a wide variation of spacings and richness occurs. However, results or selective heating may be achieved at one megahertz in any regions where the relative richness between the richest layers and the intervening layers is greater than two to one and the thickness of the leaner layers is one inch or greater. For distances having thinner layers, it may be necessary to use frequencies higher than the one megahertz example and to apply correspondingly greater electric gradients to heat the rich shale bodies at a much higher rate and/or to higher temperature, so that conversion takes place in a matter of seconds, and, hence, even small regions less than an inch across will be processed prior to thermal transfer of energy to surrounding crystalline structures.

In accordance with this invention, it is desirable that the spent shale, namely, the shale which has been already processed, exhibit as low a dielectric loss tangent as possible to the radiated energy so that even high frequency energy can penetrate deeply into the formation with relatively low absorption. For this reason, it is desirable that after every cycle of conversion of kerogen, sufficient time be allowed and the pressure at the well face be sufficiently reduced to permit a substantial amount of the gaseous material to be driven through the spent shale into the electrode to scrub the passages through the spent shale of any remnants of the products of pyrolysis of kerogen and thus, thereby reduce absorption of radiated energy. This invention also contemplates that such a scrubbing effect can be enhanced by injecting into the formation periodically through the well face gases or liquids which will drive such residual products and water vapor into the formation, and/or will react with or dissolve any remaining products of pyrolysis of kerogen in the regions between the radiator and the remaining kerogen containing regions of the oil shale body.

While the water in the oil shale is preferably largely removed either by preheating the well face to 250° F. by radiation or otherwise and opening the valve to allow the vapor to be produced in the well or by facturing the formation and driving the water vapor by its generated pressure further into the formation, it is preferred that during the application of high power radiation there be a water vapor liquid interface region beyond which the kerogen will not be converted during a particular cycle. Such a water vapor liquid interface acts to plug pores in the formation both above and below the radiated body as well as at the peripheral regions thereof so that the high pressure gas produced by pyrolysis which remains in gaseous state at pressures which will produce liquification of water will be sealed from escaping into surrounding regions of the oil shale body by the plugging action.

The temperature sensing and estimation provided by data from thermocouple 126 may be enhanced by additional temperature sensing locations in the formation, for example, ceramic tubing, (not shown) in which thermocouples can be inserted.

DESCRIPTION OF AN ALTERNATE EMBODIMENT OF THE INVENTION

In some oil shale formations which have gas tight overburdens under which the gas pressure can be produced and maintained, R.F. energy may be radiated into a formation from one region such as from a dipole radiator 10 which may be several feet in diameter supplied through a coaxial line from the surface several feet in diameter to achieve low transmission loss through several hundred feet of overburden. For such an application, this invention provides for driving the products of conversion of the kerogen as well as any moisture vaporized during the heating process outwardly away from the central radiator and collecting the products of pyrolysis in collecting wells spaced from the central radiator. As an example, a dipole radiator in an oil shale formation is initially supplied with one megawatt of power at a frequency of one megahertz, and a fluid at a suitable pressure, such as carbon dioxide at 1000 psi, is supplied continuously to the formation through apertures in the radiator by injection pump (IP) through valve 136. Application of the power produces rapid heating of the formation to temperatures in the range of 250° C. to 500° C., vaporizing any moisture in the formation in the region adjacent the electrode, producing conversion of the kerogen by pyrolysis to flowable products at temperatures in the range from room temperature to 500° C. while also producing severe horizontal fracturing between the layers of oil shale outwardly for many feet. The gas injected through electrode 10 aids in the fracturing of the oil shale and driving the products of pyrolysis horizontally outwardly toward collection wells 64 which may be from a few inches to a few feet in diameter and which may be spaced at locations a few feet to 100 feet from electrode 10. Steam or condensed water from heating the formation as well as the liquid and gaseous products of pyrolysis of the oil shale flow into collection wells. While substantial quantities of carbon dioxide may be liberated from the mineral portions of the oil shale, additional cold carbon dioxide is preferably injected through the radiating electrode structure through the central conductor 44 of the coaxial line to cool this structure and the radiator to maintain them at temperatures which are as low as practicable, for example, between 100° C. and 200° C. The injected gas flushes pyrolysis products in the portions of the formation near the radiator outwardly into the formation so that the major portion of the radiation is absorbed by unpyrolyzed kerogen. The pressure of gaseous products in the collection well may be used to drive the liquids to the surface through tubing 66 where they are cooled in tank 72 with heat exchangers (not shown) to separate the various liquid and gaseous components, and those components such as carbon dioxide, which have low commercial value, are preferably reinjected into the formation through tubing 44.

As the region around the electrode becomes depleted of kerogen, the average conductivity of the formation decreases, for example, at 100 megahertz so that the radiation loss in the formation drops from approximately one db per foot to $2.5 \times 10^{-3}$ db per foot, or by a factor of 400. While this selectivity of energy absorption varies from sample to sample and, among other things, is different for different frequencies, temperatures, and pressures, this differential in conductivity is generally at least two orders of magnitude. In addition, some pyrolysis products of kerogen become substantially more conductive, being, for example, four to five orders of magnitude higher in conductivity so that the radiated energy is absorbed substantially entirely by the outwardly moving face of kerogen and kerogen pyrolysis products after traversing the shale which has been scrubbed of the products of kerogen by the passage of the gas injected through the electrode into the formation. This process continues at a rate dependent on the power level which is preferably increased at a rate to maintain the electric field gradient at said outwardly moving face substantially constant until the production wells are reached by the outwardly moving face. For example, the power may be increased geometrically with time from one to 25 megawatts in 24 hours. The production wells are then closed in, and additional production wells at a greater distance from the radiator are used.

The foregoing process utilizes the heat supplied to the formation to heat portions of the formation further from the electrode structure so that a sweeping wave of thermal energy moves out from the electrode structure and, hence, the same thermal energy once applied to the formation is used over and over. For example, if the effective thermal region about 250° C. in which pyrolysis is occurring has a radial distance of ten feet and the regions beyond and in front of this region have a temperature below 250° C., with the outwardly radially circumferential expanding surface of the maximum temperature point moving as a function of the injected carbon dioxide and the rate of conversion, the overall formation average temperature need not reach more than one-fifth of the 500° C. temperature needed for maximum conversion rates and, in fact, need only be somewhat above the temperature needed to vaporize the free water in the formation.

This continuous heating process is disclosed by way of illustration only, and the maximum temperatures achieved may be controlled to lie anywhere within the range of 250° C. to 500° C. 500° C. was selected to illustrate a temperature region producing rapid pyrolysis can occur before substantial thermal energy transfer from the hot kerogen to adjacent cooler mineral regions of the formation which provide strength to hold open the fissues through which the pyrolysis products flow to the collecting wells. Such temperatures use, for example, the region between curves 122 and 124 of FIG. 3. However, a lower maximum temperature such as 300° C. with long times heating such as several months may be used.

In addition, the gas continuously injected through the radiator may have a pressure to force open such fissues through the 300° C. ring to the connecting wells.

Alternatively, a parasitic reflector 56 may be placed, for example, one-tenth of a wavelength away from the radiator 10, to direct the field away from the parasitic radiator while reducing the field concentration immediately adjacent the radiator 10 thereby further increasing the effectiveness of the radiator to penetrate through spent shale to more distant regions of kerogen-rich unpyrolyzed portions of the formation. Also, if, for example, multiple radiators are used, electrode 10, may spaced about a quarter wavelength (about 75 feet at 1 MH) from the next closest radiator 12. Then the space between 10 and 12 has been completely pyrolyzed and the products removed. Directivity of radiation can then be achieved in the direction away from a pyrolyzed region into new unpyrolized oil shale formations beyond the next radiator 12 at 90° phase, lagging the first radiator 10 thereby producing a directive radiation pattern along the line between the two radiators. Such directivity may be further augmented by the parasitic reflecting radiators, which, as previously described, are immersed in spent oil shale having a low conductivity and are, hence, effective in producing the desired radiation directivity. Additional radiators, each of which is one-quarter wavelengh apart may be similarly driven with appropriate phases to produce highly directional beams in accordance with well-known radiation pattern practice.

This invention discloses that the principles of selective heating and/or directive radiation patterns described herein, while disclosed in connection with in situ processing of oil shale formations, may also be applied to other organic materials which are found in situ. For example, coal seams in rock may be processed by electrodes embedded in the coal seam to heat the coal to temperatures between 500° and 1000° C. where the coal will liquify under pressure and will produce substantial quantities of gas, with initial radiation being confined to the region immediately adjacent the electrode structure. Cool air, oxygen, hydrogen, or other gases may be injected through the radiator to cool the radiation, pressurize the formation, and/or chemically react with the coal. The products may then be produced through the radiator or through collection wells as fluids, with the remaining ash around the electrode exhibiting a low loss to radiated energy so that deeper penetration into the coal formation can occur with subsequent heating cycles. A similar process may be used to dry and produce liquids and gases from tar sands, to dry and fracture oil-bearing rock of existing oil as well as to any other commercially useful material which may be processed in situ and which may or may not constitute organic material but which require selective heating of one constituent for the process. In addition, the selective heating of this invention may be used for surface retorting of mechanically mined oil shale or coal containing large amounts or rock or other material which would otherwise have to be heated as well.

This completes the description of the embodiment of the invention described herein. However, many modifications thereof, will be apparent to persons skilled in the art without departing from the spirit and scope of the invention. For example, the electric fields may be produced by electrodes of many different configurations and shapes, the electrodes may be inserted into the formation at angles other than vertical, multiple half wavelength radiators may be used and both sections of the dipole radiators may be driven in phase with a frequency lower than their resonant length while an adjacent electrode is also driven with its dipole halves in phase but out of phase with the first electrode to produce a captive field between the electrodes. Also, different frequencies may be used during the different portions of the process and the frequency may be shifted or varied to produce a mode stirring action or radiators may be raised or lowered in the formation to produce a field pattern variation. Accordingly, it is intended that this invention be not limited by the particular details disclosed herein except as defined by the appended claims.

What is claimed is:

1. The method of producing organic liquids and/or gaseous products from organic compounds contained in a mineral formation comprising the steps of:

reducing the alternating current electrical conductivity of a region of said mineral formation comprising reducing the amount of liquid water in said formation region;

supplying an electric field having a frequency in the range between 100 kilohertz to 1000 megahertz to said region of said formation at an intensity which heats said organic compounds in said region to temperatures in the range between 200° C. and 500° C. where substantial conversion of said compounds to said products occurs while adjacent portions of said formation are heated to temperatures substantially below said first temperature; and producing products derived from said organic compounds by the flow of said products through said formation .

2. The method in accordance with claim 1 wherein: said formation comprises oil shale containing kerogen and positioned beneath an overburden.

3. The method in accordance with claim 1 wherein: said step of supplying said electric field supplying an alternating current voltage between spaced electrodes in said oil shale.

4. The method in accordance with claim 1 wherein: said step of supplying said electric field comprises producing a directional radiation pattern in said formation.

5. The method in accordance with claim 4 wherein: said directional radiation pattern is one of a plurality of directional radiation patterns directed toward a central region.

6. A system for producing subsurface heating of a formation comprising:

a plurality of groups of spaced radiators extending through an overburden into a region to be heated; and means for heating predominantly organic portions of said formation at a more rapid rate than said heat is transferred by conduction from said predominantly organic portions to predominantly inorganic portions of said formation adjacent to said predominantly organic portions comprising supplying said radiators with alternating current electrical energy until the electrical conductivity of said predominantly organic portions increases substantially from the electrical conductivity of said predominantly organic portions of said formation at lower temperatures.

7. A system for producing subsurface heating of a formation comprising:

a plurality of groups of spaced radiators extending through an overburden into a region to be heated;

means for supplying said radiators with electrical energy at intensities and a frequency which produces electrical fields in said formation which heat selected organic portions of said formation at a more rapid rate than said heat is transferred by conduction from said organic portions to predominantly inorganic portions of said formation adjacent to said organic portions until a temperature is reached where the electrical conductivity of said selected organic portions is different from the electrical conductivity of similar organic portions of said formation at lower temperatures; and said radiators being positioned on the order of a half wavelength apart of said frequency in said formation.

8. The system in accordance with claim 7 wherein said radiators have parasitic reflecting elements positioned adjacent said radiators and separated therefrom by less than a quarter wavelength of said frequency to direct said radiation toward a common region of said formation to be heated.

9. The system in accordance with claim 8 wherein said parasitic radiation elements contain apertures through which liquids in said formation may be collected.

10. The system in accordance with claim 9 wherein means are provided for pumping said liquids through parasitic radiations to the surface of the overburden.

11. The method of producing organic liquid and gaseous products from kerogen contained in oil shale comprising the steps of:

supplying thermal energy to at least a portion of said oil shale to remove liquid water from said portion;

heating a region of said kerogen in said portion to a temperature in the range between 250° C. and 500° C. by subjecting said region of said oil shale to a time varying electric field having a frequency which heats said kerogen more rapidly than the adjacent shale; and collecting the products of conversion of said kerogen after a sufficient time has passed to allow a substantial portion of said kerogen to be converted to said products prior to transfer of a substantial portion of said heat to said shale.

12. The method in accordance with claim 11 wherein said step of heating said kerogen comprises subjecting said oil shale to an electric field radiated from a electrode in said oil shale.

13. The method in accordance with claim 11 wherein said heating step comprises maintaining pressure on said oil shale while heating said region.

14. The method in accordance with claim 11 wherein said field has a frequency on the order of 100 kilohertz to 100 megahertz.

15. The method in accordance with claim 14 wherein said step of allowing said conversion comprises applying an alternating electric field to said region during said conversion.

16. A method of producing pyrolytic conversion of kerogen in a region of oil shale comprising the steps of:

reducing the electrical conductivity in a predetermined frequency range of portions of said oil shale which are predominantly shale to a value substantially below said conductivity of portions of said oil shale which are predominantly kerogen comprising reducing the liquid water content of said oil shale; and pyrolytically converting a substantial portion of said kerogen to other organic compounds by heating said predominantly kerogen portions to temperatures substantially above the temperature of said predominantly shale portions comprising producing to said region electric fields having at least a component in said frequency range.

17. The method in accordance with claim 16 wherein: said step of producing said fields comprises applying a voltage between a plurality of conductive electrodes separated by a portion of a body of said oil shale.

18. The method in accordance with claim 16 wherein: said step of producing said fields comprises radiating electromagnetic wave energy.

19. The method in accordance with claim 18 wherein: the frequency of said component of said fields is above 100 kilohertz.

20. The method in accordance with claim 17 wherein said waves are radiated from electrodes in holes in said body.

21. The method of producing in situ products from kerogen in oil shale by pyrolysis comprising the steps of:

reducing the liquid water content of a region of oil shale by preheating and/or fracturing said region at temperatures below 300° C.;

selectively transferring energy to kerogen-rich portions of said region at greater rates than to kerogen-lean portions of said region to heat said kerogen-rich portions to temperatures producing substantial pyrolytic decomposition of said kerogen prior to transfer of the major portion of said heat from said kerogen-rich portions by thermal conduction to adjacent said kerogen-lean portions; and collecting products derived from said kerogen decomposition in regions of said shale oil body.

22. The method in accordance with claim 21 wherein: said step of reducing said liquid water comprises permitting water vapor generated in said body to move out of said region.

23. The method in accordance with claim 22 wherein: said step of permitting said water vapor to move out of said region of said body comprises conducting said vapor through apertured pipes in said formation to the surface of said formation.

24. The method in accordance with claim 21 wherein: said step of selectively transferring energy comprises radiating electromagnetic waves having a frequency between 100 kilohertz and 100 megahertz into said region.

25. The method in accordance with claim 24 wherein: said step of radiating said energy into said region comprises supplying electrical energy at said frequency to a dipole radiator positioned in said body.

26. The method of processing a body of oil shale comprising:

processing said body to produce a first region having a first electrical conductivity range throughout a predetermined frequency range; and radiating electromagnetic wave energy through said first electrical conductivity portion of said body into a portion of said body having a second electrical conductivity higher than said first electrical conductivity.

27. The method in accordance with claim 26 wherein said step of radiating said energy comprises placing a radiating electrode structure in said oil shale body and maintaining a pressure in said body adjacent said electrode structure sufficient to prevent a voltage breakdown in the region of said electrode structure.

28. The method in accordance with claim 26 wherein said radiation has a frequency component in the range between 100 kilohertz and 1000 megahertz.

29. The method of processing a body of oil shale comprising:

processing said body to produce in a portion of said body first conductivity for radiating waves over at least a predetermined frequency range;

radiating electromagnetic wave energy in said frequency range through said first portion of said body into a second portion of said body having a second conductivity which is higher than said first conductivity; and said energy being radiated into said body from a plurality of radiators spaced in said body by a distance greater than one-tenth wavelength of the frequency of said radiation.

* * * * *